US010555851B1

(12) United States Patent
Alahmari

(10) Patent No.: US 10,555,851 B1
(45) Date of Patent: Feb. 11, 2020

(54) EMERGENCY PATIENT BED

(71) Applicant: Ali Mousa A. Alahmari, Boston, MA (US)

(72) Inventor: Ali Mousa A. Alahmari, Boston, MA (US)

( * ) Notice: Subject to any disclaimer, the term of this patent is extended or adjusted under 35 U.S.C. 154(b) by 339 days.

(21) Appl. No.: 15/495,424

(22) Filed: Apr. 24, 2017

Related U.S. Application Data

(60) Provisional application No. 62/326,032, filed on Apr. 22, 2016.

(51) Int. Cl.

| | |
|---|---|
| ***A61G 13/00*** | (2006.01) |
| ***A61G 7/05*** | (2006.01) |
| ***A61G 7/012*** | (2006.01) |
| ***A61G 7/015*** | (2006.01) |
| ***A61G 7/005*** | (2006.01) |
| ***A61G 7/018*** | (2006.01) |
| ***A61G 7/08*** | (2006.01) |

(52) U.S. Cl.
CPC ..... *A61G 7/0503* (2013.01); *A61G 7/005* (2013.01); *A61G 7/012* (2013.01); *A61G 7/015* (2013.01); *A61G 7/018* (2013.01); *A61G 7/0516* (2016.11); *A61G 7/08* (2013.01)

(58) Field of Classification Search
CPC ..... A61G 13/00
USPC ..... 5/600, 58, 611, 503.1
See application file for complete search history.

(56) References Cited

U.S. PATENT DOCUMENTS

| | | | | |
|---|---|---|---|---|
| 2,904,798 | A | 9/1959 | Heflin | |
| 4,019,772 | A | 4/1977 | Lee | |
| 4,584,989 | A * | 4/1986 | Stith | A61G 7/00 128/870 |
| 6,546,577 | B1 * | 4/2003 | Chinn | A61G 1/0293 5/308 |
| 7,703,158 | B2 | 4/2010 | Wilker, Jr. et al. | |
| 2003/0159214 | A1 * | 8/2003 | Kurtz | A47C 17/86 5/503.1 |
| 2006/0277683 | A1 | 12/2006 | Lamire et al. | |
| 2007/0174965 | A1 | 8/2007 | Lemire et al. | |
| 2009/0158524 | A1 | 6/2009 | Patterson et al. | |
| 2011/0133938 | A1 * | 6/2011 | Hardin | A61G 7/0526 340/573.4 |
| 2016/0128468 | A1 * | 5/2016 | Lafleche | A47C 21/003 5/2.1 |

* cited by examiner

*Primary Examiner* — Fredrick C Conley
(74) *Attorney, Agent, or Firm* — Cramer Patent & Design, PLLC; Aaron R. Cramer

(57) ABSTRACT

An emergency patient bed includes a mobile base assembly, a bed platform assembly coupled to the mobile base assembly and configured to support a mattress, at least one (1) storage drawer extendably coupled within the bed platform, at least one (1) support shelf coupled to the bed platform assembly, and an independent power supply coupled to the mobile base assembly.

11 Claims, 3 Drawing Sheets

EMERGENCY PATIENT BED

RELATED APPLICATIONS

The present invention was first described in and claims the benefit of U.S. Provisional Application No. 62/326,032, filed Apr. 22, 2016, the entire disclosures of which are incorporated herein by reference.

FIELD OF THE INVENTION

The present invention relates generally to medical service beds and, more particularly, to an emergency bed for a medical patient.

BACKGROUND OF THE INVENTION

Emergency room doctors must deal with a large amount of information and conditions when caring for their patients. Literally seconds can mean the difference between life and death. While many of these parameters are out of their control, their working environment should not be. Unfortunately, even the newest and best equipped trauma hospitals can be put to the test when dealing with a large number of causalities. Room space can become hard to find, patients are placed on stretchers in hallways, there is no place to set equipment, hanging space for intravenous line assemblies (IV's) is non-existent, and critical equipment to save lives cannot be found.

Accordingly, there exists a need for a means by which a bed space in emergency room areas can be enhanced to address the problems as described above.

SUMMARY OF THE INVENTION

The inventor has recognized the aforementioned, inherent problems and lack in the art and observed that there is a need for an emergency patient bed that provides bedridden patients a means to increase their comfort and dignity at a time they need it the most. The development of the present invention, which will be described in greater detail herein, fulfills this need.

In an embodiment, the disclosed apparatus includes a mobile base assembly, a bed platform assembly coupled to the mobile base assembly and configured to support a mattress, at least one storage drawer extendably coupled within the bed platform, at least one (1) support shelf coupled to the bed platform assembly, and an independent power supply coupled to the mobile base assembly.

In an embodiment, the disclosed self-contained medical bed includes a base assembly including a swivel wheel assembly coupled to each corner, a plurality of trash receptacles removably coupled to the base assembly, a cylinder holder coupled to the base assembly and configured to retain a cylindrical oxygen tank, a suction machine enclosure located adjacent to a head end of the base assembly, a lockable patient locker coupled to the base assembly, a rechargeable battery system coupled to the base assembly and comprising at least one electrical outlet, a bed platform assembly coupled to the base assembly, a lift mechanism operably intercoupled between the base assembly and the bed platform assembly to adjust an angular position of a head end and a foot end of the bed platform assembly, a mattress supported on the bed platform assembly, a pair of retractable side rails extendably coupled to the bed platform assembly at opposing sides of the mattress, at least one (1) first storage drawer extendably coupled within the bed platform assembly, at least one (1) second storage drawer extendably coupled within the bed platform assembly, the second storage drawer having a storage capacity greater than the first storage drawer, an x-ray cassette drawer extendably coupled within the bed platform, at least one (1) equipment shelf coupled to the bed platform assembly, and a patient table extendably coupled to the bed platform assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
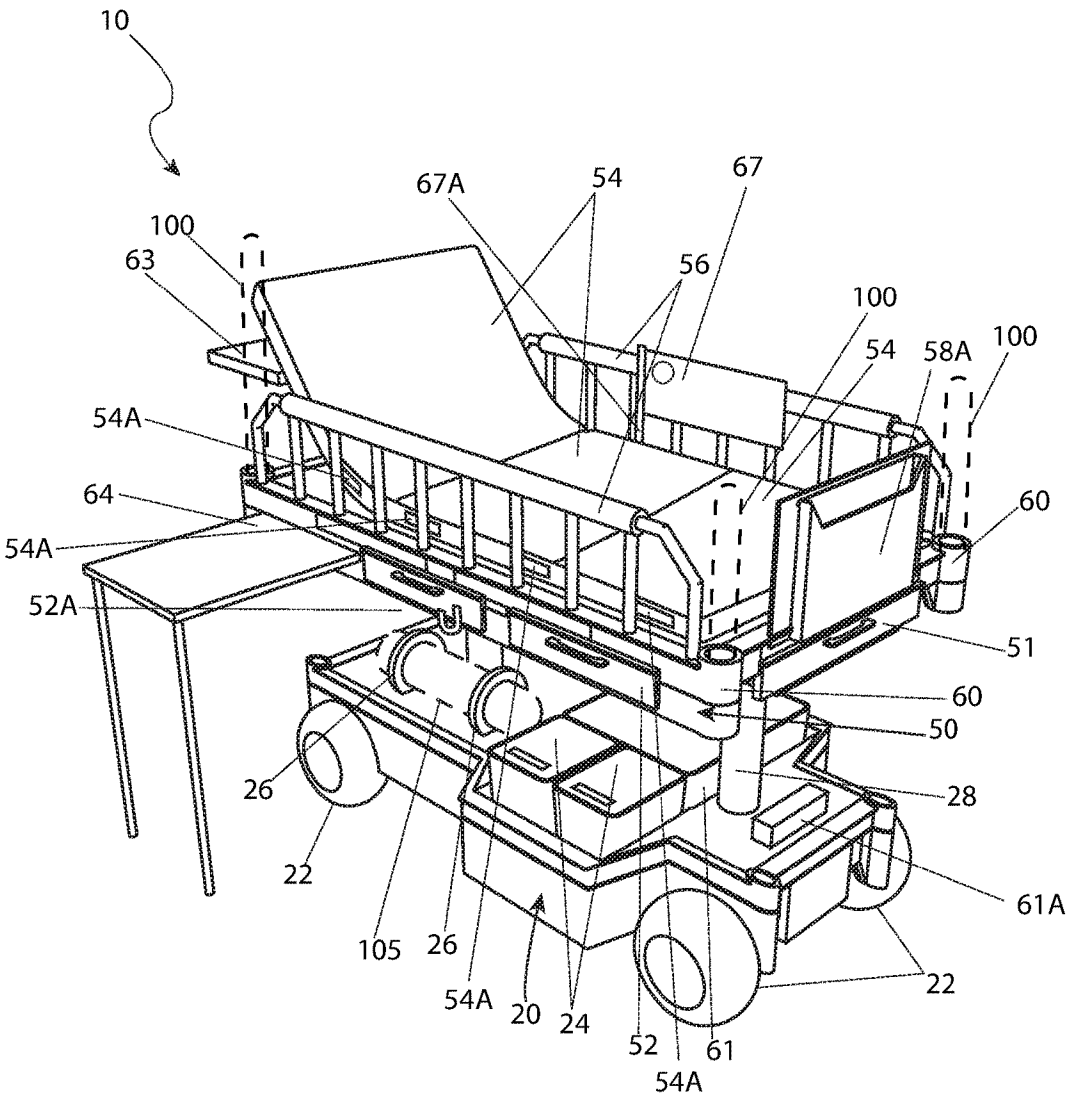
FIG. 1 is a perspective view of an embodiment of the disclosed emergency patient bed.

10 emergency patient bed (apparatus)
20 base assembly
22 wheel
24 trash receptacle
26 oxygen cylinder holder
28 lift mechanism
50 bed platform assembly
51 monitor and defibrillator shelf
52 shallow drawer
52A ambu bag storage hook
53 deep drawer
54 mattress
54A mattress webbing structure
56 rail
58A chart/file holder
58B smart panel
60 equipment mount
61 battery system
61A direct-to-alternating current (DC to AC) inverter
62 alternating current (AC) outlet
63 first equipment shelf
64 second equipment shelf
66 third equipment shelf
67 folding table for patient use
67A articulated support arm
68 display device
72 patient's locker
74 x-ray cassette drawer
100 pole element
105 oxygen cylinder
110 curtain
115 grommet
120 cable

DETAILED DESCRIPTION OF THE PREFERRED EMBODIMENT

Figure 2:
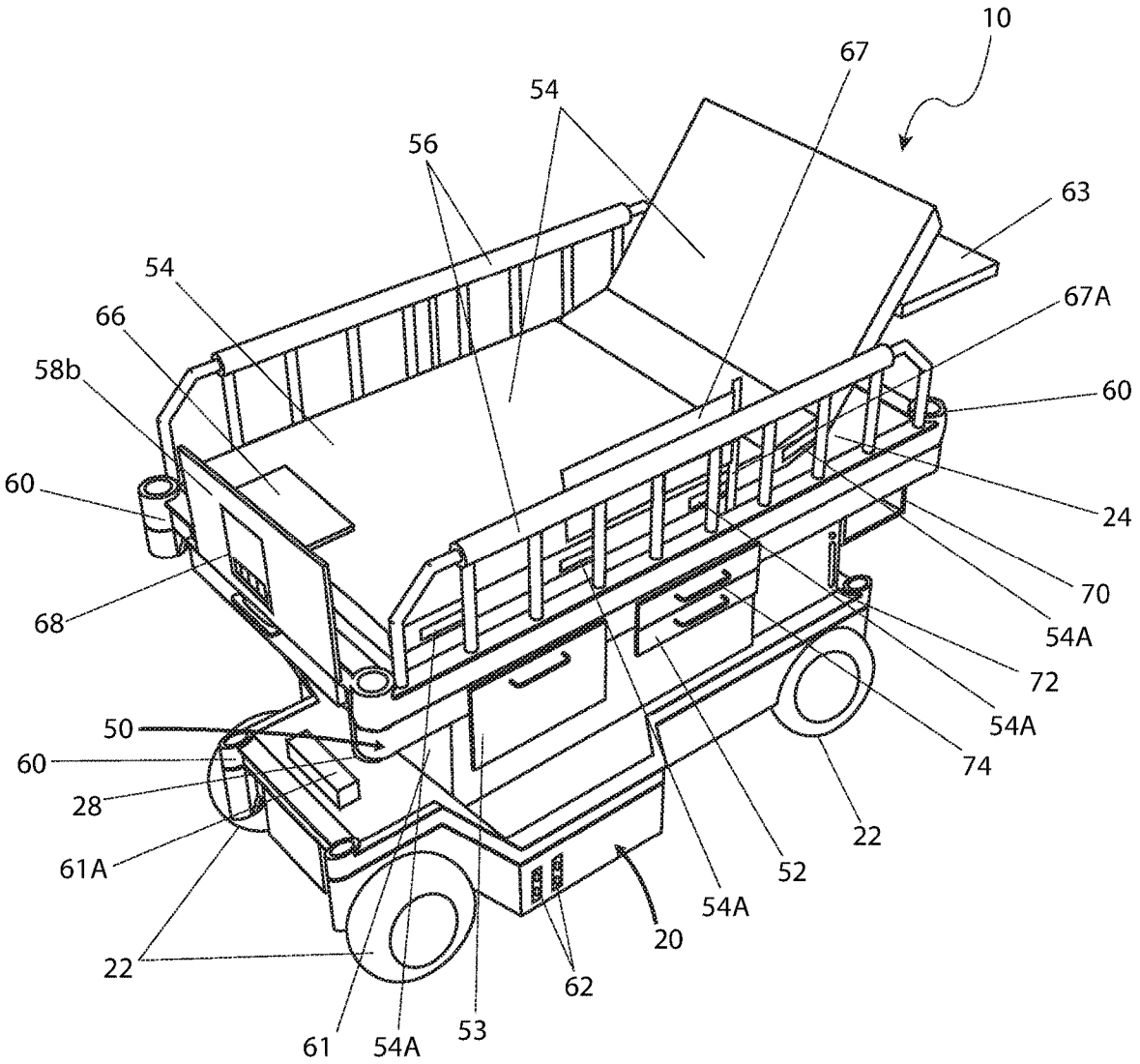
FIG. 2 is an opposing perspective view of an embodiment of the emergency patient bed; and, FIG. 3 is a perspective view of another embodiment of the disclosed emergency patient bed depicting deployment of a curtain.
Figure 3:
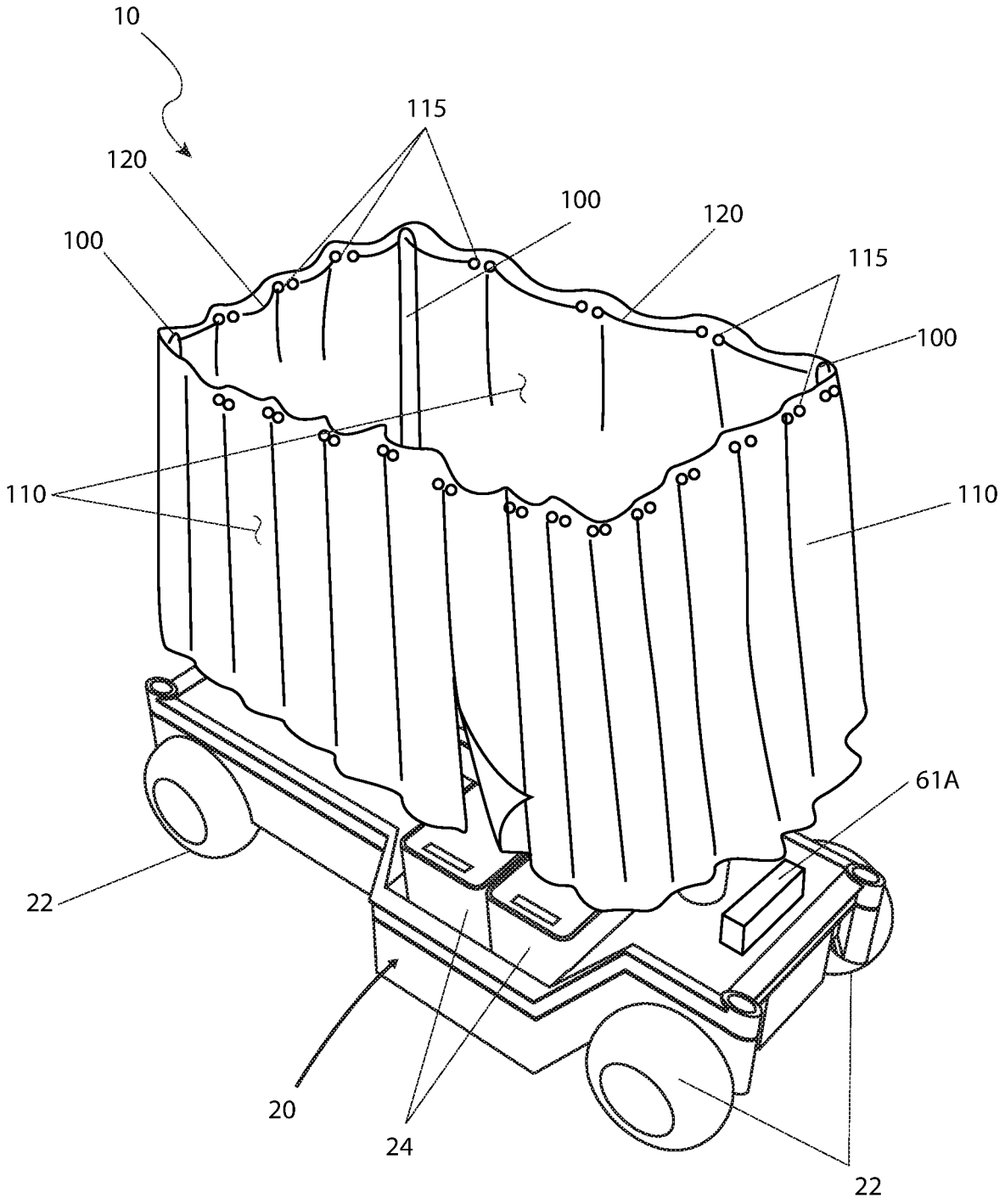

In accordance with the invention, the best mode is presented in terms of example embodiments, herein depicted within FIGS. 1-3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

The terms "a" and "an" herein do not denote a limitation of quantity, but rather denote the presence of at least one (1) of the referenced items.

Referring to FIGS. 1-3, disclosed is an emergency patient bed, (herein generally identified as the "apparatus") 10, where like reference numerals represent similar or like parts. The disclosed apparatus 10 includes a mobile emergency room hospital bed with enhanced features that provide patient care advantages when used in an emergency room space.

In an example, the apparatus 10 includes features including, but not limited to: a monitor and defibrillator shelf 51, multiple large storage drawers 52, 53, equipment shelves 63, 64, and equipment mounts 60 for mounting a privacy curtain 110, IV stands, and the like. Beneficially, the apparatus 10 enables hospital personnel to provide complete emergency care in a mobile manner, even in a hallway area when necessary.

FIGS. 1 and 2 illustrate right and left perspective views of an example of the apparatus 10. The apparatus 10 includes a rectangular base assembly 20 having swiveling and selectively-locking wheel assemblies 22 located at each bottom corner, thereby allowing a care giver to secure the apparatus 10 in a position, as well as maneuver the apparatus 10 across a floor surface as needed. The base assembly 20 also provides a plurality of removable trash receptacles 24, an oxygen cylinder holder 26, a suction machine enclosure 70 adjacent to a patient's head area, and a secure patient's locker 72.

The trash receptacles 24 may be utilized to hold normal waste material as well as sharp or bio-hazardous materials to help keep a patient area clean and safe. The oxygen cylinder holder 26 provides a means to retain a stationary or portable oxygen cylinder 105.

The base assembly 20 also houses an on-board rechargeable battery system 61 that provides electrical power to internal electrical systems of the apparatus 10, as well as providing power to operate various peripheral emergency care equipment via a plurality of electrical alternating current (AC) outlets 62 via use of a direct-to-alternating current (DC to AC) inverter 61A. It is envisioned that the on-board rechargeable battery system 61 would provide a useful operating cycle of at least six hours (6 h) before recharging is required. However, the on-board rechargeable battery system 61 could be provided with other life-cycle capacities in an equally effective manner, and as such, the use of any particular operating time should not be interpreted as a limiting factor.

The base assembly 20 also includes a lift mechanism 28, preferably of a hydraulic type, which provides attachment of and vertical adjustment of a superjacent bed platform assembly 50 to allow for raising and lowering of the bed platform assembly 50.

The bed platform assembly 50 includes a rectangular planar structure that provides a stable surface upon which a comfortable hospital-type mattress 54 is placed. The bed platform assembly 50 is to provide full-range angular adjustment of both the head and foot areas of the mattress 54, including Trendelenburg position and reverse-Trendelenburg positioning capabilities.

The mattress 54 is envisioned to include a patient lifting means such as mattress webbing 54A complete with handles along perimeter edge portions to enable rolling or removing the patient in a stable manner to examine the patient's back side. The mattress webbing 54A will provide an assist system to make it easy for care provider instead of several to accomplish the transfer procedure. This medical webbing 54A also functions as a restraint system.

The bed platform assembly 50 also includes retractable side rails 56 and/or additional restraining equipment, as needed, to protect the patient from falling or doing harm to themselves.

The bed platform assembly 50 further includes a plurality of shallow drawers 52, and at least one (1) deep drawer 53, for larger equipment. The drawers 52, 53 are located along vertical perimeter surfaces of the bed platform assembly 50. The drawers 52, 53 are envisioned to provide, secondary internal lids to prevent contamination, safety latches to prevent unintended opening during movement of the bed platform assembly 50, and are to be recessed approximately one inch (1 in.) from the perimeter edge of the bed platform assembly 50 to prevent any liquids from contaminating the equipment.

Additionally, the drawers 52, 53 are provided with internal movable dividers for purposes of organizing equipment. This equipment would include, but not be limited to, patient head drawer, used to contain air way equipment (preferably located near patient's head), with organizers to allow for placement of each item in separate row; an intravenous drawer (preferably located near patient's side); a chest tube set with multiple sizes (preferably located near patient's side); a urinary catheter set (preferably located near patient's side) a simple surgical & dressing set (preferably located near patient's side); and an orthopedic set (preferably located near patient's feet).

The monitor and defibrillator shelf 51 pulls out from the bed platform assembly 50 to provide a suitable and accessible location for the placement of defibrillators and other medical equipment that may be immediately required for patient resuscitation.

The drawers 52, 53 are intended for the storage of materials, supplies, and equipment such as, but is not limited to, airway equipment; central lines; cervical collars, IV equipment, Folly's catheters, nasogastric tubes (NGT), chest tubes, needle decompressions, surgical equipment, splints, and grip bandages, suction equipment, a defibrillator, various orthopedic equipment, and other critical life-saving equipment and supplies.

An ambu bag storage hook 52A is provided on the exterior of one (1) of the drawers 52 for placement of bag valve mask to provide a suitable and accessible location for the placement of defibrillators and other medical equipment that may be immediately required for patient resuscitation.

The bed platform assembly 50 also includes an x-ray cassette drawer 74 located along a side surface. The x-ray cassette drawer 74 enables horizontal insertion of a standard x-ray cassette below the mattress 54 and below the patient's torso area, thereby avoiding transfer of the patient from the apparatus 10 during the performance of x-ray procedures.

The bed platform assembly 50 is also envisioned to include a fold-down first equipment shelf 63 located at a head location; a removably attachable large second equipment shelf 64 which attaches to, and protrudes horizontally from a side surface thereof, being capable of supporting heavy equipment such as monitors, suction machines, and the like.

The apparatus 10 is shown in FIG. 1 being configured with a stationary chart/file holder 58A located at a foot portion of the previously described bed platform assembly 50.

The apparatus 10 is illustrated in FIG. 2 being optionally configured with a smart panel 58B which enables wireless electronic data entry and retrieval via equipment such as, but not limited to: a digital display device 68 such as an IPAD®, touch-screen computer, or the like; a plurality of interface cables and connections (Universal Serial Bus (USB) for personal electronic device charging, a personal audio entertainment system for playback of digital sound files, and the like); and, a cellular phone communication interface.

The smart panel 58B is also envisioned to provide a horizontal third equipment shelf 66 along a top edge portion, enabling positioning of associated equipment such as monitors, a defibrillator, and the like, as needed.

A folding table for patient use 67 is provided on one (1) side of the bed platform assembly 50 and would be used for holding food, beverage, writing utensils, and personal items. The folding table for patient use 67 is supported by an articulated support arm 67A that provides for both folding and retracting of the folding table for patient use 67 and is envisioned to be similar to the ones that used to be in the arm of airline seats.

These features of the apparatus 10 are intended to allow emergency room personnel to intubate, electorate, cannulate, and resuscitate patients at various locations within a healthcare facility, even in a hallway if necessary.

The dimensions of the apparatus 10 are envisioned to be approximately ninety-six inches (96 in.) in length, forty-two inches in (42 in.) width, and thirty-six inches (36 in.) in height.

The apparatus 10 also includes hollow cylindrical equipment mounts 60 permanently affixed at each of the four (4) corners of the bed platform assembly 50. The equipment mounts 60 provide a means to install peripheral equipment such as, but not limited to: a privacy curtain 110, removable IV stands, and the like (see FIG. 3).

FIG. 3 illustrates a perspective view of another example of the apparatus 10 depicting deployment of a privacy curtain 110. In an example of the apparatus 10, the equipment mounts 60 (FIGS. 1 and 2) provide removable insertion of respective vertical pole elements 100 that act to support a privacy curtain 110. As seen in FIG. 3, the pole elements 100 support a length of cable 120, which in turn supports the privacy curtain 110.

A plurality of equally-spaced grommets 115 are arranged along a top edge of the rectangular privacy curtain 110, being inserted upon the cable 120 and allowing easy deployment and retraction of the privacy curtain 110 along the cable 120.

It is understood that other peripheral equipment which utilize similar pole elements 100 may be mounted to the equipment mount portions 60 of the apparatus 10 such as, but not limited to, removable IV stand posts, and the like, with equal benefit.

It is envisioned that other styles and configurations of the disclosed apparatus 10 can be easily incorporated into the teachings of the present disclosure, and only one certain configurations have been shown and described for purposes of clarity and disclosure and not by way of limitation of scope.

Examples of the disclosed apparatus 10 can be utilized by the common user (e.g., a medical professional or a patient) in a simple and effortless manner with little or no training. After initial purchase or acquisition of the apparatus 10, it would be configured and utilized as indicated in FIGS. 1-3.

An example method of preparing the apparatus 10 for use may be achieved by performing the following steps: procuring the apparatus 10; loading all needed materials, supplies, and equipment into the drawers 52, 53 such as airway equipment; central lines; cervical collars, IV equipment, Folly's catheters, nasogastric tubes (NGT), chest tubes, needle decompressions, surgical equipment, splints and grip bandages, suction equipment, a defibrillator, various orthopedic equipment, and other critical life-saving equipment and supplies into the drawers 52, 53; placing appropriate emergency equipment and supplies upon the first equipment shelf 63 and the second equipment shelf 64; mounting IV stands, as needed using respective pole elements 100 and equipment mounts 60; and, mounting and securing an oxygen cylinder 105 onto the base assembly 20 using the oxygen cylinder holder 26. The apparatus 10 is now ready for use.

An example method of utilizing the apparatus 10 may be achieved by performing the following steps: pushing the apparatus 10 upon its wheels 22 to a location where it is needed; locking the wheels 22; laying a patient onto the mattress 54; adjusting the height of the bed platform assembly 50 as needed using the lift mechanism 28; adjusting the angle of the head and foot portions of the mattress 54 as needed; deploying the rails 56 to their raised positions, if desired; installing a privacy curtain 110 or IV setups upon the pole elements 100, as needed; utilizing the oxygen cylinder 105 as needed to provide oxygen to the patient; utilizing the equipment shelves 63, 64 to support various equipment as needed; utilizing the pre-loaded materials, supplies, and equipment stored within the drawers 52, 53 to perform necessary emergency treatments upon the patient; and, benefiting from improved mobility and equipment accessibility of an emergency patient bed, afforded a user of the present invention 10.

An example method of utilizing the privacy curtain 110 of the apparatus 10 may be achieved by performing the following steps: inserting the pole elements 100 into respective equipment mounts 60; routing the cable 120 through grommet portions 115 of the curtain 110, if not previously routed; securing the cable 120 to top portions of each pole element 100; and, deploying or retracting the curtain 110 along the cable 120 as needed.

The example method of utilization provides for organization of the equipment in one (1) place. The self-contained stand-along performance makes it ideal for use in a field hospital or overflow emergency room operations. It decreases the time needed for resuscitation and provides an overall reduction of chaos during resuscitation and mass causality phase resulting in an overall death rate reduction and improved quality of life.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. An apparatus, comprising:

a mobile base assembly;

a bed platform assembly coupled to said mobile base assembly and configured to support a mattress, said bed platform assembly includes a fold-down first equipment shelf located at a head location, a removably attachable large second equipment shelf which attaches to and protrudes horizontally from a side surface thereof, being capable of supporting one or more pieces of heavy equipment;

at least one storage drawer extendably coupled within said bed platform; and an independent power supply coupled to said mobile base assembly;

a lockable patient locker coupled to said mobile base assembly;

at least one of a chart holder and a smart panel coupled to a foot end of said bed platform assembly, said smart panel includes a horizontal third equipment shelf along a top edge portion, enabling positioning of one or more pieces of associated equipment;

a privacy curtain removably coupled to said bed platform assembly;

a plurality of equipment mounts, one of said equipment mounts being coupled to each corner of said bed platform assembly, wherein said privacy curtain is coupled to and retained by said equipment mounts;

wherein said privacy curtain, comprises:

a plurality of pole elements, one of said pole elements being received within said one of said equipment mounts;

a cable interconnected between said pole elements; and, a curtain coupled to and extending along said cable;

wherein independent power supply, comprises:

a rechargeable battery system;

a DC to AC converter; and at least electrical outlet;

wherein said at least one support shelf comprises at least one of a head end support shelf coupled to a head end of said bed platform assembly and a foot end support shelf coupled to a foot end of said bed platform assembly; and wherein said at least one support shelf comprises an equipment support shelf extendably coupled to a side of said bed platform assembly.

2. The apparatus of claim 1, wherein said at least one storage drawer comprises a plurality of first storage drawers extendably coupled within said bed platform assembly, and wherein said first storage drawers are located along at least one vertical perimeter surface of said bed platform assembly.

3. The apparatus of claim 2, wherein said at least one storage drawer further comprises a second storage drawer extendably coupled within said bed platform assembly, wherein said second storage drawer is located along one vertical perimeter surface of said bed platform assembly, and wherein said second storage drawer has a storage capacity greater than said first storage drawers.

4. The apparatus of claim 1, further comprising a cylinder holder coupled to said base assembly and configured to retain a cylindrical oxygen tank.

5. The apparatus of claim 1, further comprising an ambu bag storage hook coupled to said at least one storage drawer.

6. The apparatus of claim 1, further comprising at least one x-ray cassette drawer extendably coupled within said bed platform assembly, wherein said x-ray cassette drawer is located along one vertical perimeter surface of said bed platform assembly, and wherein said x-ray cassette drawer has a storage capacity configured to horizontally receive an x-ray cassette.

7. The apparatus of claim 6, wherein said x-ray cassette drawer is located below a torso region of said bed platform assembly.

8. The apparatus of claim 1, further comprising a plurality of trash receptacles removably coupled to said base assembly.

9. A self-contained medical bed, comprising:

a base assembly comprising a swivel wheel assembly coupled to each corner;

a plurality of trash receptacles removably coupled to said base assembly;

a cylinder holder coupled to said base assembly and configured to retain a cylindrical oxygen tank;

a suction machine enclosure located adjacent to a head end of said base assembly;

a lockable patient locker coupled to said base assembly;

a rechargeable battery system coupled to said base assembly and comprising at least one electrical outlet;

a bed platform assembly coupled to said base assembly;

a lift mechanism operably intercoupled between said base assembly and said bed platform assembly to adjust an angular position of a head end and a foot end of said bed platform assembly;

a mattress supported on said bed platform assembly;

a pair of retractable side rails extendably coupled to said bed platform assembly at opposing sides of said mattress;

at least one first storage drawer extendably coupled within said bed platform assembly;

at least one second storage drawer extendably coupled within said bed platform assembly, said second storage drawer having a storage capacity greater than said first storage drawer;

an x-ray cassette drawer extendably coupled within said bed platform;

at least one equipment shelf coupled to said bed platform assembly;

a patient table extendably coupled to said bed platform assembly; and a privacy curtain removably coupled to said bed platform assembly.

10. The self-container medical bed of claim 9, further comprising a plurality of equipment mounts, one of said equipment mounts being coupled to each corner of said bed platform assembly, wherein said privacy curtain is coupled to and retained by said equipment mounts.

11. The self-container medical bed of claim 10, wherein said privacy curtain comprises:

a plurality of pole elements, one of said pole elements being received within said one of said equipment mounts;

a cable interconnected between said pole elements; and, a curtain coupled to and extending along said cable.

* * * * *